United States Patent [19]

Horie et al.

[11] 4,260,904

[45] Apr. 7, 1981

[54] POWER FEED CONTROL DEVICE FOR COPYING APPARATUS

[75] Inventors: Yoshihiro Horie, Toyokawa; Kenzo Nagata, Okazaki; Manabu Hatano, Toyohashi, all of Japan

[73] Assignee: Minolta Camera Kabushiki Kaisha, Osaka, Japan

[21] Appl. No.: 74,678

[22] Filed: Sep. 12, 1979

[30] Foreign Application Priority Data

Sep. 19, 1978 [JP] Japan ..... 53/129282[U]

[51] Int. Cl.[3] ..... G03G 15/00

[52] U.S. Cl. ..... 307/113; 271/258; 355/145 H

[58] Field of Search ..... 355/14 R, 14 SH; 271/258, 259; 307/112, 113–115, 142, 326, 328

[56] References Cited

U.S. PATENT DOCUMENTS 3,692,401 9/1972 Kawai ..... 355/14 R X

*Primary Examiner*—L. T. Hix
*Assistant Examiner*—James L. Dwyer
*Attorney, Agent, or Firm*—Watson, Cole, Grindle & Watson

[57] ABSTRACT

A power feed control device for copying apparatus which merely requires closing of door or cover to set the apparatus to a power feedable condition after removal of jammed copying paper is disclosed. The device comprises a change-over switch responsive to opening and closing of the door to form normally opened contact and normally closed contact, said change-over switch is so arranged to be connected to a power source and also to a drive circuit as well as to a jam detecting circuit through the normally closed contact while the same is also connectable to a power feed control relay through the normally opened contact. The change-over switch being so connected that the opening of door will cut off the supply of power to said drive and said jam detection circuits whereas the closing of the door will automatically set the power feedable condition for said drive and jam detection circuits so as to enable the apparatus to resume copying operation.

4 Claims, 5 Drawing Figures

POWER FEED CONTROL DEVICE FOR COPYING APPARATUS

FIELD OF THE INVENTION

The present invention relates to a power feed control device for copying apparatus, and more particularly to an improvement thereof which is capable of automatically setting the apparatus to a power feedable condition upon closing of a door or an outer cover of the apparatus following the occurrence of paper jam and removal of the jammed paper.

BACKGROUND OF THE INVENTION

While there have been proposed various types of electrophotographic copying apparatuses, they are normally assembled to have an openable door or an outer cover for the purpose of access into the interior thereof. This is necessary for the removal of jammed paper or for inspection purposes such as for replacement of the photosensitive member and replenishment of developer. And in these apparatuses, there is normally provided a jam detecting means for detecting jamming of copying paper and when this means detects the copying paper jam, as will be further explained hereinbelow, driving means which drives the various elements such as the photosensitive member and paper feeding rollers is deenergized immediately to halt the copying operation. Simultaneously therewith, a lamp indicating the occurrence of the copying paper jam is lit to warn the operator of the apparatus. The removal of jammed copying paper is effected manually by opening the door or the outer cover, but since the apparatus is normally provided with a switch which remains closed when the door is in closed position and which opens when the door is opened, the opening of the door will effect actuation of the switch. This switch, when opened, functions to cut off power completely from a power source to the copying apparatus. With the jammed copying paper removed, the door is closed to resume copying operation. However, there is a problem that since the power has been cut off completely, the apparatus must be brought to a power feedable condition upon closing of the door. This is to say that the jam detection circuit must be restored to an initial condition and the apparatus brought to a power feedable condition.

Heretofore, a resetting switch actuatable together with a main switch was provided to bring the apparatus to a power feedable condition. However, the problem or drawback with this switch is that it is always necessary to press the same manually while pressing the main switch simultaneously. This is rather troublesome and there is a need for a simple and improved power feed control device.

SUMMARY OF THE INVENTION

It is accordingly a primary object of the present invention to provide a novel and improved power feed control device for copying apparatus free of the aforedescribed drawbacks.

Another object of the present invention is to provide an improved power feed control device for copying apparatus which is capable of automatically setting the apparatus to a power feedable condition upon closing of the door or the outer cover of the apparatus following the opening of the door for the purpose of removal of jammed copying paper.

Still another object of the present invention is to provide an improved power feed control device for copying apparatus which is simple in its circuit construction and which merely requires closing of the door to bring the apparatus to a power feedable condition.

These and other objects of the present invention are achieved by providing a power feed control device for copying apparatus which comprises a change-over switch responsive to opening and closing of the door to form a normally opened contact and a normally closed contact. The change-over switch is so arranged to be connected to a power source and also to a driving means as well as to a jam detecting circuit through the normally closed contact while the same is also connectable to a power feed control relay through the normally opened contact. The change-over switch being so connected that the opening of the door will cut off the supply of power to the driving means and to the jam detection circuit whereas the closing of the door will automatically set the power feedable condition for the driving means and jam detecting circuit so as to enable the apparatus to resume copying operation.

For a fuller understanding of the nature and objects of the present invention, reference is made to the following detailed description taken in conjunction with the accompanying drawings.

DESCRIPTION OF THE PREFERRED EMBODIMENTS

Figure 1:
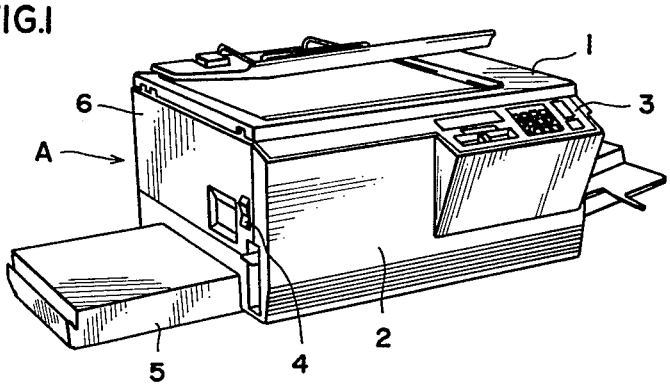
FIG. 1 is a perspective view of a copying apparatus incorporating a power feed control device in accordance with the present invention.

Referring to FIG. 1, there is shown an electrophotographic copying apparatus A used for producing copies from an original placed on a reciprocatingly movable original carriage 1. Immediately below the original carriage 1 and at its front side, an outer cover or frame 2 which may be opened downwardly from the closed position of FIG. 1 is provided for access into the interior of the apparatus. This outer cover 2 is hinged at its lower ends by means not shown and openable for the purpose of inspection such as for replacement of a photosensitive drum as well as for removal of jammed copying paper.

The apparatus further includes on its external surfaces various elements such as a control panel 3, a main switch 4 and a paper cassette 5. Means such as a print switch, exposure control lever, jam warning lamp and copy counter are all provided on the control panel 3 for controlling copying operation of the apparatus A. The main switch 4 is provided on the side cover 6 and supplies power to the apparatus.

Figure 2:
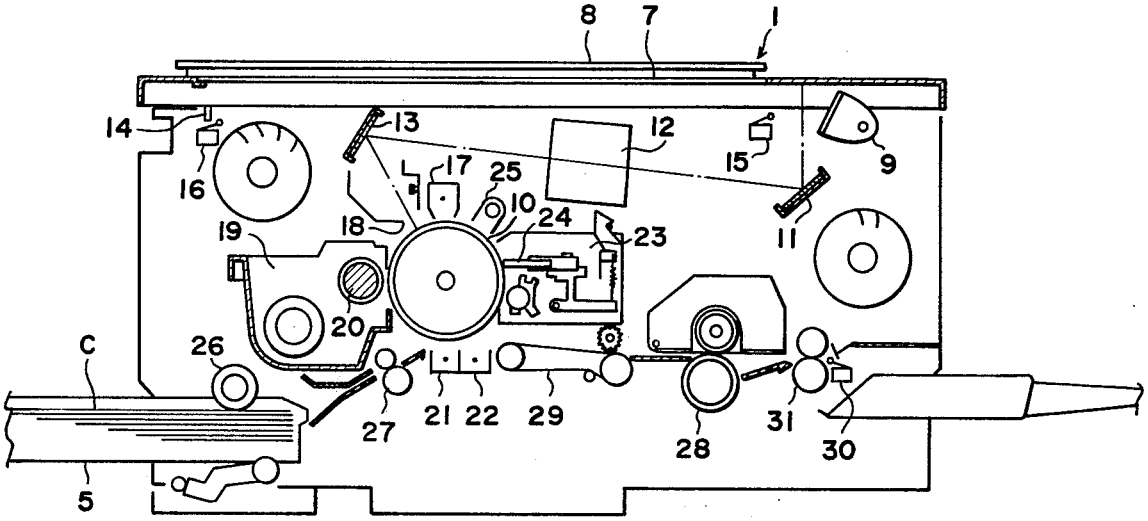
FIG. 2 is a cross sectional view of the copying apparatus shown in FIG. 1.

In the copying apparatus shown in FIG. 2, original carriage 1 is movably supported on the body proper and includes a transparent glass 7 on which an original to be copied is placed and an original cover 8 for firmly pressing the original. In the stationary condition, the original carriage 1 is in the position shown in FIG. 2 and upon initiation of copying operation, the same is moved to the right to scan the original. As the carriage 1 is moved, the original thereon is exposed by an exposure lamp 9 and the image thereof is successively projected onto a rotating photosensitive drum 10 through a first mirror 11, a projection lens 12 and a second mirror 13. The original carriage 1 has an actuating lever 14 fixedly provided at its one end and when the carriage 1 has moved substantially the length of the original, actuating lever 14 actuates a return switch 15 provided immediately below the carriage 1. The actuation of this return switch 15 terminates the scanning movement of the carriage and in turn moves the carriage 1 back to its initial position, when the carriage has returned to its initial or home position, the actuating lever 14 actuates a home position switch 16 to stop the return movement of carriage 1.

The photosensitive drum 10 is rotatable in the counterclockwise direction and includes therearound a corona charging means 17 for uniformly charging the surface of drum 10, an exposure slit 18 through which the image of the original is projected, a developing means 19 having a magnetic roller 20 for developing an electrostatic latent image formed on the drum 10, an image transferring charger 21 for transferring the developed image onto a copying paper C, a separating charger 22 for separating the copying paper C from the drum 10, a cleaning device 23 having an elastic blade 24 in contact with the surface of drum 10 for cleaning residual toner therefrom and an erasing means 25 for erasing residual charges. The copying papers C are stored in the paper cassette 5 and fed one-by-one by a feeding roller 26. The paper fed therefrom is transported to an image transferring area through rollers 27 and after the image has been transferred, it is fed through heat fixing rollers 28 by way of a transporting belt 29. A jam detecting switch 30, as will be further explained hereinbelow, is provided immediately adjacent to discharging rollers 31 for actuation by a leading edge of copying paper C. When this switch 30 fails to detect the presence of copying paper within a predetermined time, a motor (not shown) which drives all of the movable elements such as photosensitive drum 10, original carriage 1, rollers 26, 27, 28, 30 and belt 29 are deenergized to halt the copying operation.

When the jamming of copying paper occurs in the copying apparatus described above, the outer cover 2 would be opened for removing the jammed copying paper C. However, the conventional electrical circuit for controlling power feed to the apparatus required an additional switch for setting the apparatus to a power feedable condition. A further problem is that this switch was necessary to be actuated manually simultaneously with the main switch. This conventional electrical circuit will now be explained more in detail with reference to FIG. 3.

Figure 3:
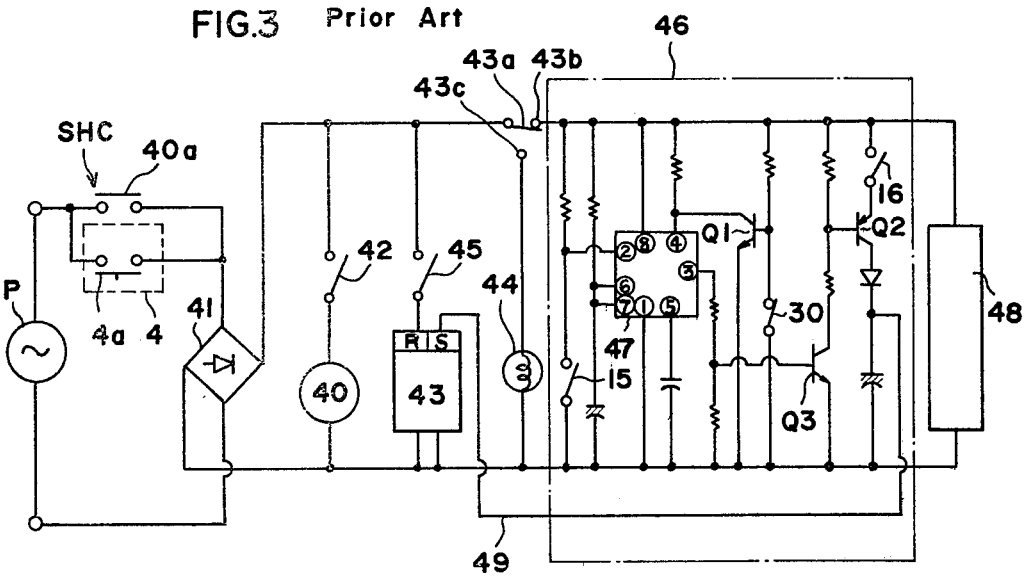
FIG.3 Prior Art
FIG. 3 is a conventional electrical circuit for the power feed control device incorporated in the copying apparatus.

In FIG. 3, a manually operable and automatically returnable switch 4 (hereinafter referred to as main switch) has a normally opened switch arm **4*a* and this forms a self holding circuit SHC together with a normally opened switch 40*a* of a first relay 40. Power from a power source P such as a commercial AC power source is fed through the self holding circuit SHC to a rectifier 41 where the AC voltage is rectified to DC voltage (full wave rectification). In series with the first delay 40 is a cover switch 42 having a normally closed switch arm and this switch 42 is provided in such position to be closed and opened by the outer cover 2. In other words, the switch arm of this cover switch 42 is held closed when the outer cover 2 is in closed position and opens when the outer cover 2** is opened.

In parallel with the first relay 40 is a second or control relay 43 having a set terminal S and a reset terminal R. A change-over switch **43*a* for the second relay 43 is switchable between first and second contacts 43*b* and 43*c* and is normally in contact with the first contact 43*b*. When the jamming of copying paper occurs as will be further explained, the second relay 43 will set to switch over the change-over switch 43*a* to the second contact 43*c* and this in turn energizes a jam warning lamp 44 connected in series with the second contact 43*c*. In series with the reset terminal R of second relay 43 is a resetting switch 45 normally in connection with the contact thereof. This resetting switch 45 is usually provided within the apparatus A just inside the outer cover 2. As is apparent, switch 45 will be pressed simultaneously with the main switch 4** to set the apparatus to a power feedable condition.

A portion of the circuit enclosed by a single dot chain line designates the circuit 46 for jam detection and includes among other elements the jam detecting switch 30 (normally closed switch) provided at the discharging end of copying paper path adjacent to the discharging rollers 31, an IC (integrated circuit) package 47 connected to the first contact **43*b*, first, second and third switching transistors Q1, Q2 and Q3, the return switch 15 (normally opened switch) actuatable by the lever 14 when the carriage has completed the scanning of the original and the home position switch 16 (normally opened switch) actuatable by lever 14 when the carriage 1** has returned to its home position.

A block designated by 48 represents a circuit for drive means and may be regarded as a circuit for controlling the motor which drives elements such as photosensitive drum 10, feeding means 26, 27, 29, 28 and 31 and carriage 1. When copying paper C fails to arrive at the jam detecting switch 30 within a predetermined time, the jamming of copying paper is detected and this causes the change-over switch **43*a* to switch over to the second contact 43*b*. This then stops the supply of power to the drive circuit 48 and jam detection circuit 46 and simultaneously lights the jam warning lamp 44. Power from the source P is continuously fed to these circuits 46 and 48 by keeping the switch 43*a* in contact with the first contact 43*b*** when no jamming of copying paper is detected.

The operation of the circuit shown in FIG. 3 will now be explained. It is assumed that the change-over switch **43*a* contacts first contact 43*b* and that the jam detecting switch 30 is also closed. Needless to say, cover switch 42 and resetting switch 45 are also closed. Upon actuation of main switch 4, the first relay 40 is energized to form self holding circuit SHC so as to continuously supply power from power source P through the switch 40*a*. Next, a print instructing switch (not shown) is manually actuated to begin copying operation. This will cause the photosensitive drum 10 to rotate, the paper C to be fed and the original carriage 1 to move for scanning. When the carriage 1 has moved substantially the length of the original, the actuating lever 14 hits the return switch 15 to close the same. By the actuation of this switch 15, the carriage 1** terminates the scanning movement and immediately begins return movement. At this moment, the voltage L at the terminal 2 of IC package 47 becomes low whereas the voltage H at the terminal 3 becomes high.

Jam detection for copying paper is determined basically in the following manner such that after the actuation of return switch 15 by lever 14 and when the jam detecting switch 30 remains closed (i.e., not actuated by copying paper) by the time the carriage has returned to its home position to actuate the home position switch 16, the jam detection circuit detects the jamming of copying paper C. Accordingly, if the carriage 1 has returned to its home position and closes the home position switch 16 while the jam detecting switch 30 remains closed, the third switching transistor Q3 is turned on by the terminal voltage at terminal 3 which is at voltage H and simultaneously turns on the second transistor Q2. Thereby, a predetermined value of voltage is applied to the set terminals of second relay 43 through a line 49 to set the relay 43 which in turn switches over the change-over switch 43*a* to the second contact 43*c*, thereby lighting the jam warning lamp 44 to warn the operator. This then cuts off supply of power to the jam detection circuit 46 and drive circuit 48. As can be understood, the resetting switch 45 opens simultaneously therewith.

The outer cover 2 will then be opened to remove the jammed copying paper. The opening of cover 2 will open the cover switch 42 to deenergize the first relay 40 so as to release the self holding circuit SHC. To resume copying operation after the jammed paper has been removed, the resetting switch 45 is pressed manually to close the same and to reset the second relay 43 to switch over the change-over switch 43*a* to the first contact 43*b*. This resetting switch 45 must be pressed simultaneously with the main switch 4 as the power has been completely cut off. With the second relay 43 restored or reset to its initial condition, the outer cover 2 is now closed to close the cover switch 42. This brings the apparatus to a power feedable condition and the main switch 4 may now be pressed to feed the power again.

With the main switch 4 turned on and the print instructing switch actuated to resume copying operation, the original carriage 1 moves to scan the original until the lever 14 thereof actuates the return switch 15. Assuming that copying paper is transported smoothly with no jamming, the leading edge thereof actuates the jam detecting switch 30 to open the same. The actuation of switch 30 occurs before the carriage 1 returns to its home position, i.e., before the lever 14 actuates the home position switch 16. When the jam detecting switch 30 is opened by the paper, the first transistor Q1 is turned on to set the terminal voltage at terminal 4 of IC package 47 to level L. Consequently, the terminal voltage at terminal 3 is also set to level L so that even when the lever 14 on carriage 1 actuates the home position switch 16, no voltage will be applied to the set terminal S of second relay 43 since both second and third transistors Q2 and Q3 are in a deenergized state. Accordingly, the changeover switch 43*a* is held in contact with the first contact 43*b* to enable continuous power feed to the jam detection circuit 46 and drive circuit 48.

Thus, once the copying paper jam is detected in the circuit for the power feed control device as described above, it is always necessary to manually operate the resetting switch 45 together with the main switch 4 which is quite inconvenient.

In accordance with the power feed control device of the present invention, the only step necessary to restore the apparatus to a power feedable condition is the closing of the outer cover, and this will be explained with reference to FIG. 4. It should be noted that the same numerals are used for parts identical to those shown in FIG. 3.

Figure 5:
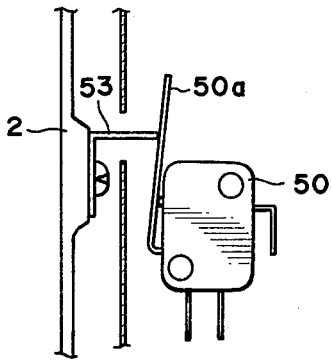
FIG. 5 is a view showing a door and a switch means actuatable by opening and closing actions of the door.
Figure 4:
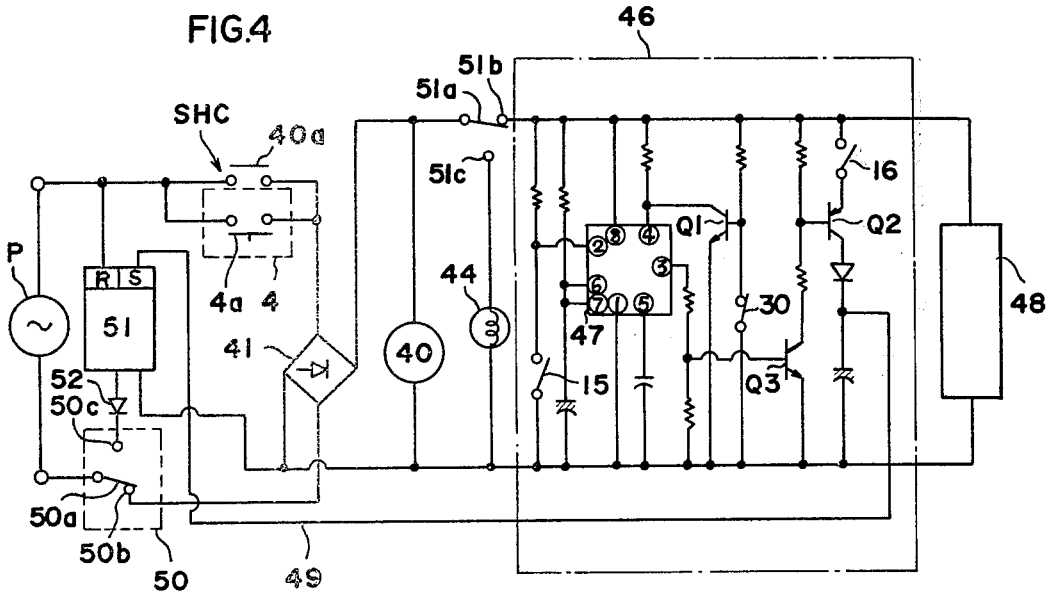
FIG. 4 is an electrical circuit for the power feed control device in accordance with the present invention and which is incorporated in the copying apparatus shown in FIGS. 1 and 2.

The circuit of FIG. 4 differs from that of FIG. 3 basically in the provision of a control cover switch 50 instead of the resetting switch 45. This switch 50 has a switch arm 50*a* which is switchable between first contact 50*b* (normally closed contact) and second contact 50*c* (normally opened contact) by opening and closing actions of the outer cover 2. As can be seen in FIG. 5, the switch arm 50*a* for control cover switch 50 is held closed by a projection arm 53 fixed to the cover 2 when the cover 2 is fully closed and opens to switch over to the second contact 50*c* when the cover 2 is opened. With the switch arm 50*a* normally in connection with the first contact 50*b*, the power source P is connected to the jam detection circuit 46 and drive circuit 48. The control relay 51 is similar to that of the second relay 43 described above and includes in series a diode 52 for supplying DC (rectified) voltage. A changeover switch 51*a* for the control relay 51 is normally in connection with the first contact 51*b* and when the jam detection circuit 46 detects the jamming of copying paper C, a predetermined value of voltage is applied to the set terminal S of control relay 51 to switch over the switch 51*a* to the second contact 51*c* which in turn energizes the jam warning lamp 44.

The actuation of main switch 4 will energize the first relay 40 to form self holding circuit SHC through the switch 40*a*. Next, the print instructing switch (not shown) is manually actuated to begin the copying operation and if the jam detecting switch 30 remains closed (i.e., not actuated by copying paper) even when the lever 14 of carriage 1 actuates the home position switch 16, the jamming of copying paper is detected and applies a predetermined voltage to the set terminal S of control relay 51 through a line 49. This sets the relay 51 and switches over the change-over switch 51*a* to the second contact 51*c* which in turn energizes the jam warning lamp 44. Simultaneously therewith, power to the drive circuit 48 is terminated and brings the apparatus to rest condition. It should be noted that the jam detection circuit 46 functions in the same manner as that of FIG. 3.

The outer cover 2 is now opened to remove the jammed copying paper C and this opening will switch over the switch arm 50*a* of cover switch 50 to the second contact 50*c*. As a result, the control relay 51 is set to switch over the changeover switch 51*a* to the first contact 51*b*. The opening of cover 2 will deenergize the first relay 40 to open its switch 40*a* so as to cut off supply of power completely. After the removal of paper, the outer cover 2 is closed to resume the copying operation. Closing of cover 2 will switch over the cover switch 50*a* for connection with the first contact 50*b*. This then will bring the apparatus to a power feedable condition and the main switch 4 may now be pressed to begin the next copying operation.

Assuming that copying paper C is transported smoothly this time with no jamming, the leading edge of the paper will actuate the jam detecting switch 30 to open the same within a predetermined time. The actuation of switch 30 occurs before the carriage 1 returns to its home position, i.e., before the lever 14 actuates the home position switch 16. When the jam detecting switch 30 is opened by the paper, the first transistor Q1 is turned on to set the voltage at terminal 4 of IC package 47 to voltage L. In consequence, the voltage at terminal 3 is also set to L so that even when the lever 14 on carriage 1 actuates the home position switch 16, no voltage will be applied to the set terminal S of control relay 51 since both second and third transistors Q2 and Q3 are in a deenergized state. Accordingly, the change-over switch 51*a* is held in contact with the first contact 51*b* to enable continuous power feed to the jam detection circuit 46 and drive circuit 48.

While there have been described preferred embodiments of the present invention, it is apparent that numerous alterations, additions and omissions may be made without departing from the spirit thereof.

What is claimed is:

1. In a power feed control device for copying apparatus which comprises:

a power source;

a drive circuit and a jam detection circuit connected to said power source;

a power feed control relay having a change-over switch switchable between a first contact for connection with said drive and jam detection circuits and a second contact for out of connection therewith;

an outer cover for access into interior of the copying apparatus; and a cover switch actuatable by opening and closing actions of said cover and switchable between a normally opened contact when the cover is opened and a normally closed contact when the cover is closed, said switch being so arranged to be connected with said power source and said drive and jam detection circuits when at said normally closed contact and to be connected with said control relay when at said normally opened contact.

2. In a power feed control device for copying apparatus which comprises:

a power source;

a drive circuit for controlling various driving means in the copying apparatus;

a jam detection circuit for detecting jamming of copying paper;

a power feed control relay having a change-over switch switchable between a first contact for connection with said drive and jam detection circuits and a second contact for out of connection therewith, said control relay being controlled to switch over said change-over switch to said second contact when said jam detection circuit detects the jamming of copying paper so as to cut off supply of power to said drive circuit;

an outer cover for access into interior of the copying apparatus; and a cover switch actuatable by opening and closing actions of said cover and switchable between a normally opened contact when the cover is opened and a normally closed contact when the cover is closed, said switch being so arranged to be connected with said power source and said drive and jam detection circuits when at said normally closed contact and to be connected with said control relay when at said normally opened contact so that the opening of said outer cover automatically switches over said change-over switch to said first contact and the closing of said cover switches over said cover switch to said normally closed contact thereby setting the apparatus to a power feedable condition.

3. A power feed control device as claimed in claim 2 further including a main switch and a relay actuatable thereby to form a self holding circuit.

4. A power feed control device as claimed in claim 2 wherein said jam detection circuit includes a detecting means disposed at a discharging end of path for the copying paper and when said detecting means fails to detect presence of copying paper within a predetermined, said control relay is actuated to switch over said change-over switch to said second contact.

* * * * *